US006065592A

United States Patent [19]

Wik

[11] Patent Number: 6,065,592

[45] Date of Patent: May 23, 2000

[54] ARTICLE FOR ASSISTING PERSONS TO QUIT SMOKING AND METHOD FOR SAME

[76] Inventor: Dennis Ole Wik, Box 298, Potter Valley, Calif. 95469

[21] Appl. No.: 09/317,491

[22] Filed: May 24, 1999

Related U.S. Application Data

[63] Continuation of application No. 09/073,200, May 4, 1998, Pat. No. 5,938,017.

[51] Int. Cl.[7] ..... B65D 85/10

[52] U.S. Cl. ..... 206/256; 220/507; 220/524; 220/528; 131/270

[58] Field of Search ..... 206/242, 248, 206/256, 257, 258, 264, 265, 267, 276; 131/329, 270; 220/524, 528, 507

[56] References Cited

U.S. PATENT DOCUMENTS

| | | | |
|---|---|---|---|
| 4,793,478 | 12/1988 | Tudor | 206/256 |
| 5,011,018 | 4/1991 | Keffeler | 220/524 |
| 5,810,164 | 9/1998 | Rennecamp | 206/256 |
| 5,938,017 | 8/1999 | Wik | 206/256 |

*Primary Examiner*—Jacob K. Ackun
*Attorney, Agent, or Firm*—PatentPro

[57] ABSTRACT

An article for assisting persons to quit smoking and a method for doing same comprising a cigarette case; an insert located within said cigarette case and dividing its interior into a plurality of spaces, each sized to hold a single cigarette; and a plurality of closure devices, each of which can be used to seal one such space as the smoker gradually tapers daily cigarette consumption downward. A preferred embodiment includes a clear plastic shell covering the outside of said cigarette case, behind which shell such inspirational and motivational materials as photographs, other images, and/or handwritten or printed matter may be positioned in such a way as to be visible to the user each time the cigarette case is accessed.

2 Claims, 5 Drawing Sheets

ARTICLE FOR ASSISTING PERSONS TO QUIT SMOKING AND METHOD FOR SAME

This is a continuation of Ser. No 09/073,200 filed May 4, 1998 now U.S. Pat. No. 5,938,017.

BACKGROUND OF THE INVENTION

This invention relates generally to the field of anti-smoking products or devices, and more particularly to an article for assisting persons to quit smoking and method for same.

Cigarette smokers who wish to break their habit currently have two choices: they can quit all at once, or they can taper their consumption downward over a period of time. Since nicotine is powerfully addictive, neither approach is easy.

Quitting all at once ("cold turkey") severely disrupts the individual's brain chemistry. He or she is likely to experience intense cravings for tobacco, and may also suffer such unpleasant effects as nausea, depression, insomnia, constipation or diarrhea, irritability, muscle aches, headache and difficulty concentrating. But since nicotine is water-soluble and is readily flushed from the body, the strictly chemical phase of nicotine addiction passes within a few days or weeks.

Nevertheless, relapse is distressingly common, even among individuals whose systems have been clear of nicotine for months. This is because cigarette addiction is not merely a chemical issue: it is a complex behavior pattern that includes automatic, unconscious, habitual and psychological components as well. A sudden quit may not give the smoker time to deal with such issues. And yet, in spite of these drawbacks, the cold turkey quit (often backed up by medication) remains the method of choice for most cessation programs.

One might reasonably ask why the smoker wouldn't choose to taper cigarette consumption downward over a period of time in order to give the body a chance to adjust to a more gradual withdrawal of nicotine. Success by tapering requires the individual to limit his or her consumption to a specific number of cigarettes per day, and to decrease that number steadily and systematically over a period of weeks or even months. Sustaining this kind of long-term effort in the turbulent real world is difficult under any circumstances. It is especially difficult if access to cigarettes is open-ended and uncontrolled.

Accordingly, inventive minds have generated a number of U.S. patents for devices that are designed to assist the quitting smoker to pace consumption. U.S. Pat. No. 4,037,719, for example, discloses a cigarette case which includes a counting mechanism that keeps track of and displays the number of times the case has been opened in order to remove a cigarette. For purposes of comparison, it also displays the number of times the case was accessed the previous day.

A number of other patents have been granted for cigarette cases that are equipped with timers. U.S. Pat. No. 5,566,855, for example, discloses a cigarette case with a rotating mechanism inside. At predetermined intervals, the mechanism brings another cigarette to a position where it may be removed through an opening in the case, thus restricting the individual's freedom to smoke at will. U.S. Pat. No. 5,203,472 uses a movable belt to achieve the same purpose.

U.S. Pat. No. 4,862,431 discloses a cigarette case that, at the time of loading, allows the user to set a timing interval. After this interval has elapsed, the case emits a pleasing beeping sound to indicate that it is permissible for the user to open the cover of the case and remove a cigarette. The elapsed time is displayed at all times. If the case is opened prematurely, a loud, irritating alarm results. In an alternative embodiment, the cigarette case cannot be opened at all until the preset time has elapsed. A number of other patents disclose devices that also employ timer-controlled locking mechanisms.

U.S. Pat. No. 4,615,681 discloses a cigarette dispenser that "waits" for a preset time interval to pass after the latch is activated. This permits the user to reconsider the decision to smoke and to allow the initial urge for a cigarette to subside. If the dispenser is opened prior to the expiration of the predetermined time interval, as revealed by a visual signal, an embarrassing sound results. Programmable control means are provided for regulating cigarette access times, cigarette puffing delays, etc., as a function of the individual users smoking pattern.

U.S. Pat. No. 4,269,203 discloses a cigarette case with a lower reservoir containing an odorous substance and a series of hollow needles that extend upward into the interior of the case. When a pack of cigarettes is pushed down into the case, the needles penetrate some of the cigarettes in the pack, allowing the odorous substance to taint them.

U.S. Pat. No. 3,963,033 discloses a battery-powered cigarette case with a lid controlled by a releasable latch. On actuation of the latch, the device sounds an alarm and then applies a faradic shock to the user.

In assessing these inventions, one might well ask, "What are the minimum requirements for a device and method that can truly assist a smoker to quit by means of the tapering method?" At a minimum, the smoker must remember that tapering is a rationing process and so must be kept totally and unambiguously aware at all times of the number of cigarettes that are allowed for the day; the number that have been smoked so far during the day; and the number that remain and must last until bedtime. Without such knowledge, any tapering process becomes vague, murky and inconclusive, and it is the quitting attempt itself that tapers away, rather than the cigarette habit.

Judged by this standard, all of the devices just described suffer certain deficiencies, as further outlined. A cigarette case that merely tracks and displays daily cigarette consumption imposes no real discipline on any given day's consumption, and could end up merely documenting the failure of the individual's efforts to quit.

In regard to a timer-equipped cigarette case that prevents access until another cigarette is permissible and makes a noise if opened ahead of schedule, research has shown that people generally do not smoke at a steady rate throughout the day. Thus it is entirely likely that the individual might not feel like smoking at some of the times indicated by the device, and may feel uncomfortable cravings at others. In addition, the smoker might not always be in a situation where smoking is possible at the times indicated by the timing device. For example, smokers have been known to sit in a parking lot for ten minutes while waiting for their next allotted cigarette, rather than going about their normal routines. Rigid, externally-imposed smoking schedules can thus lead to inconvenience, frustration, and abandonment of the cessation effort.

A programmable, user-interactive cigarette case is subject to the same deficiencies as mentioned for other devices relying on timers, with the additional disadvantage that a substantial proportion of the potential users will be unable to understand and practice the programming techniques involved. Additionally, all cigarette cases with built-in motors, counting devices and/or timers require fairly complicated manufacturing processes to produce, so that the cost to the user is relatively high.

A cigarette case that renders a random selection of cigarettes distasteful by tainting them with a foul-smelling substance could prompt the user who is counting on a nicotine hit to discard the unpleasant cigarettes and smoke the untainted ones instead. And a cigarette case that relies on an electric shock to deter the user might deliver either a pinprick so weak that its deterrent effect would be minimal, or a jolt so strong that the smoker would be deterred from using the device at all.

In sum, none of these devices meet the minimum requirements outlined above. It is little wonder that the cold turkey approach to smoking cessation has gained favor at the expense of the steady taper.

In contrast, the device and method that are the subject of this application were designed to meet and exceed those minimum requirements. They allow the smoker first to determine his or her actual daily cigarette consumption, and then to carry only that number of cigarettes each day. The individual always knows how many cigarettes are allowed for the day and has a clear view of how many cigarettes have been used and how many remain. Within the constraints of the rigidly controlled daily allotment, he or she is free to smoke according to whatever schedule is most convenient and comfortable. Bodily nicotine levels fall very gradually, thus sparing the user the torments reported by smokers who attempt to quit all at once. Additionally, the individual can slowly but progressively decrease the daily cigarette allotment as the tapering process continues, at whatever pace he or she finds most appropriate.

This device and method put the responsibility for cessation squarely on the smoker, where it belongs, and not on a timer or silicon chip. The individual develops and progressively strengthens his or her ability to ration the daily allotment so that the cigarettes do not run out before bedtime. The various habitual, automatic and unconscious behaviors that are part of the individual's addiction inevitably become apparent as the tapering process continues, and the person is able to linger at any given daily consumption level for as long as it takes to deal with them. Then he or she ratchets the daily ration downward another notch.

This invention also provides a means by which the user can attach motivational aids like photographs and written materials to the cigarette case in such a way that they will be visible each time the case is accessed. Thus a father, in order to help keep his quit program on course, might attach to one side of the cigarette case a picture of his wife and children, and to the other a signed pledge to quit.

All of this is accomplished by means of a device that is easy to understand and to use, that has no moving or electronic parts, and that can be mass produced easily and at low cost using readily-available machinery.

SUMMARY OF THE INVENTION

The primary advantage of the invention is to provide a device and a method whereby a smoker can easily determine how many cigarettes he or she smokes each day and then taper his or her daily cigarette consumption, bodily nicotine level and cravings for tobacco downward in a manner that is slow and steady; that requires a minimum of discipline; and that avoids the discomfort of quitting all at once.

Another advantage of the invention is to provide a cigarette container whose capacity can be repeatedly reduced over a period of days, weeks or months as the tapering process continues, at a pace that is determined by and comfortable for the individual, and a method for using same.

Yet another advantage of the invention is to provide a device and a method that allow the smoker to deal with the psychological, habitual, unconscious and automatic aspects of tobacco addiction over a period of days, weeks or months, as the nicotine level in his or her body steadily and gradually falls.

Still another advantage of the invention is to provide a cigarette container to which the smoker can attach photographs of loved ones, written lists of reasons to quit, images of damaged lungs, and/or other motivational materials that will be visible each time he or she accesses the container.

A further advantage of the invention is to provide a device and a method for smoking cessation that is easy to understand, easy to use, easy to manufacture, and low in cost, and that requires no medications, whether sold over the counter or by prescription only.

Other advantages of the present invention will become apparent from the following descriptions, taken in connection with the accompanying drawings, wherein, by way of illustration and example, an embodiment of the present invention is disclosed.

In accordance with the preferred embodiment of the present invention, an article for assisting persons to quit smoking comprises a cigarette case; an insert located within the cigarette case and dividing the interior of the cigarette case into a plurality of spaces, each of which can hold a single cigarette; and a plurality of closure devices, each of which can be used to seal one such space. A clear shell that covers the cigarette case and allows display of photographs, text, and other motivational materials in such a way that they will be visible each time the cigarette case is accessed may be added.

In accordance with another preferred embodiment of the present invention, a method for assisting persons to quit smoking comprises determining the target number of cigarettes to be smoked per day; placing the target number of cigarettes into a cigarette case insert having a plurality of spaces, each capable of holding one cigarette; permanently sealing any spaces beyond the target number by inserting a non-removable closure device into each space to be so sealed; and then, over a period of days, weeks or months, as determined by the smoker, repeatedly reducing the capacity of the cigarette case insert by inserting an additional closure device into another space, continuing until the daily cigarette allotment has fallen to one per day, at which time a complete quit is relatively easy. A clear shell that covers the cigarette case and allows display of photographs, text, and other motivational materials in such a way that they will be visible each time the cigarette case is accessed may be added.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

This article of manufacture and method are intended to assist smokers to break the cigarette habit by allowing them to determine the specific number of cigarettes that will last them for one day; to allow them to carry and smoke only that target number of cigarettes each day; to allow them to see at any time the number of cigarettes that remain and that must last until bedtime; to allow them to decrease the number of cigarettes carried and smoked each day in an orderly and progressive manner, on a schedule that is determined by themselves alone, in accordance with their own personal circumstances and in a manner that takes into account their personal comfort; and to do all of this easily, inexpensively, and without the use of nicotine substitutes or medications of any kind.

Figure 1:
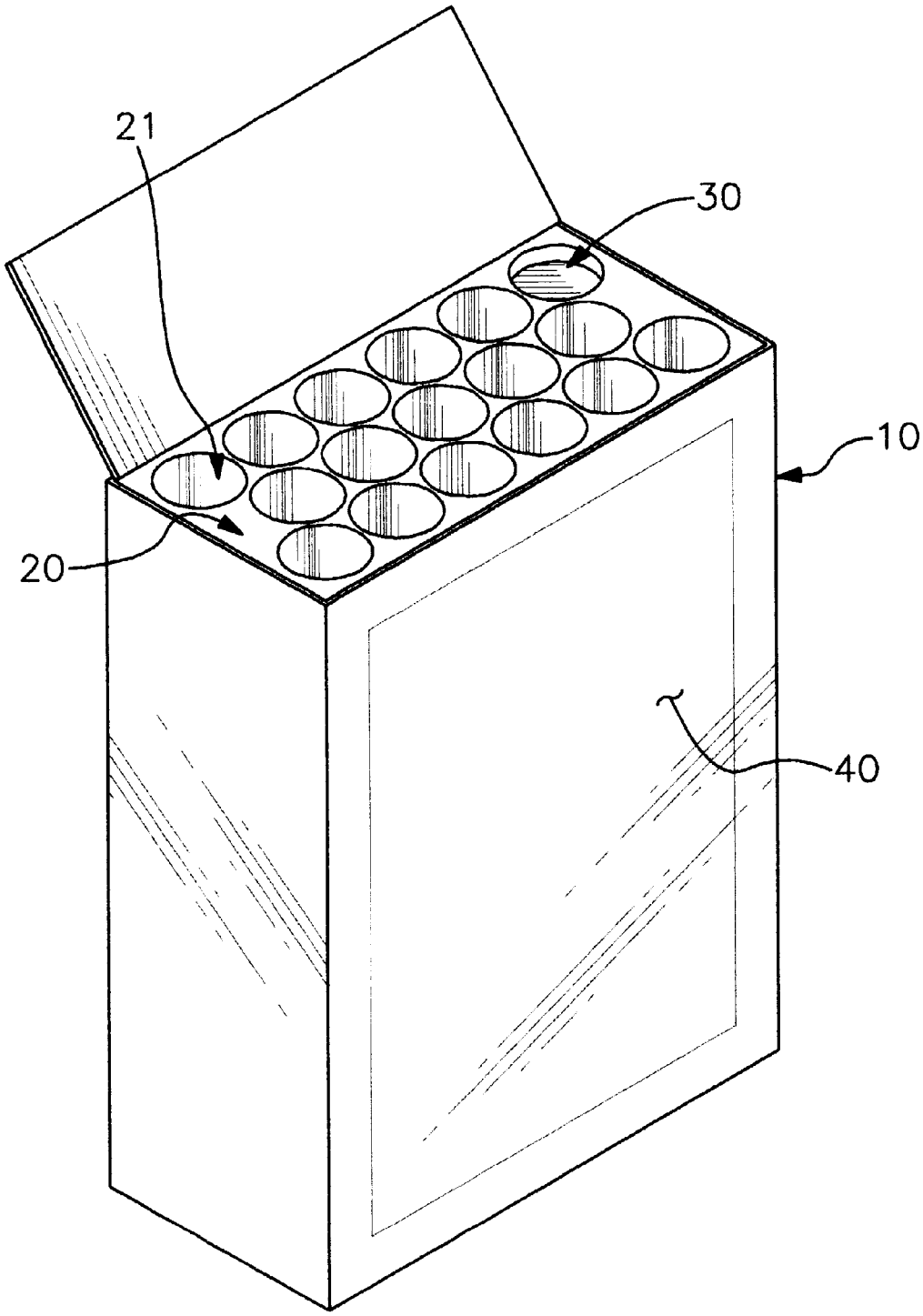
FIG. 1 is a perspective view of a hinged cigarette case according to the present invention.
Figure 2:
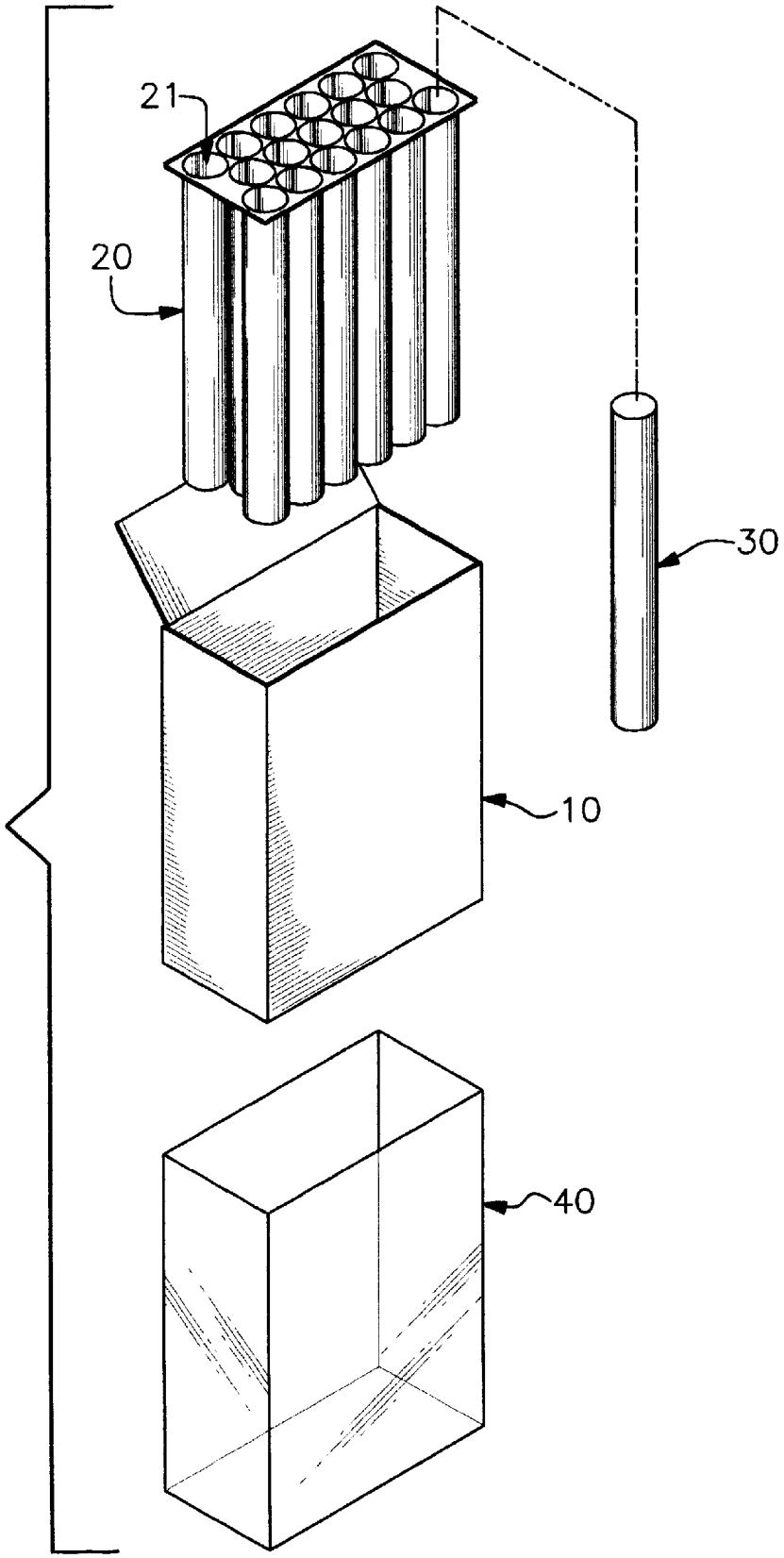
FIG. 2 is an exploded view of the hinged cigarette case of FIG. 1.

Turning first to FIGS. 1 and 2, there is shown a hinged cigarette case 10 which is similar in materials and construction, though not necessarily in size or shape, to other containers that have been on the market for many years, such as those containing dental floss. Alternate embodiments might look nothing at all like a cigarette case, as a means of breaking habitual patterns by presenting the user with a completely different means of accessing cigarettes.

Although similar to other containers, cigarette case 10 is provided with means by which a clear plastic shell 40 may be attached in such a way as to cover outer surface of case 10. In the preferred embodiment, outer case shell 40 is generally designed in size to house cigarette case 10.

In accordance with an important feature of the present invention, FIG. 2 shows an insert 20 that fits inside cigarette case 10. Insert 20 divides the interior of case 10 into a plurality of spaces 21, each capable of holding a single cigarette. In the preferred embodiment, the spaces are in the form of tubes that are open at the top and closed at the bottom. It will be appreciated that it is possible to form the case and insert as a single part, although this may require more material. It will also be appreciated that any number of individual spaces 21 may be present depending upon personal choice and size design.

During initial use of the invention, herein referred to as Stage One, the user estimates the number of cigarettes that will be needed to get through one day. At the beginning of the day, the user loads that number of cigarettes into the spaces 21 in insert 20, each cigarette in its own space. The user smokes as usual throughout the day, and quickly learns whether the initial estimate was high or low. Based on this knowledge, he or she adjusts the number of cigarettes placed into the cigarette case the following day.

It is permissible during Stage One to carry additional cigarettes in one's pocket, purse, car, etc., and to obtain more from external sources. Thus there is never any danger of running out of cigarettes or of feeling deprived, since the smoker would simply use cigarettes from another source if the cigarette case were emptied before the end of the day.

Within a reasonably short period of time the user will have determined a "target number", which is the specific number of cigarettes that is needed to get through an entire day without discomfort or feelings of deprivation. For a person with fluctuating daily use, this number may be the greatest number of cigarettes normally smoked in a day's time. Having determined the target number, the user gradually becomes accustomed to loading that number of cigarettes into individual spaces 21 of insert 20 at the beginning of each day, and to smoking only those, without reliance on outside sources for any additional cigarettes.

Stage One ends when the user is confident that he or she can consistently and comfortably make it through an entire day without using any cigarettes beyond the target number, carried only in cigarette case 10. For a person with fluctuating daily use, there may occasionally be cigarettes left over at the end of the day.

At the next stage, herein referred to as Stage Two, the smoker is ready to commit firmly to his or her target number of cigarettes per day and, in accordance with another important feature of the present invention, to close those spaces 21 within the cigarette case insert 20 that are in excess of the target number.

Figure 3:
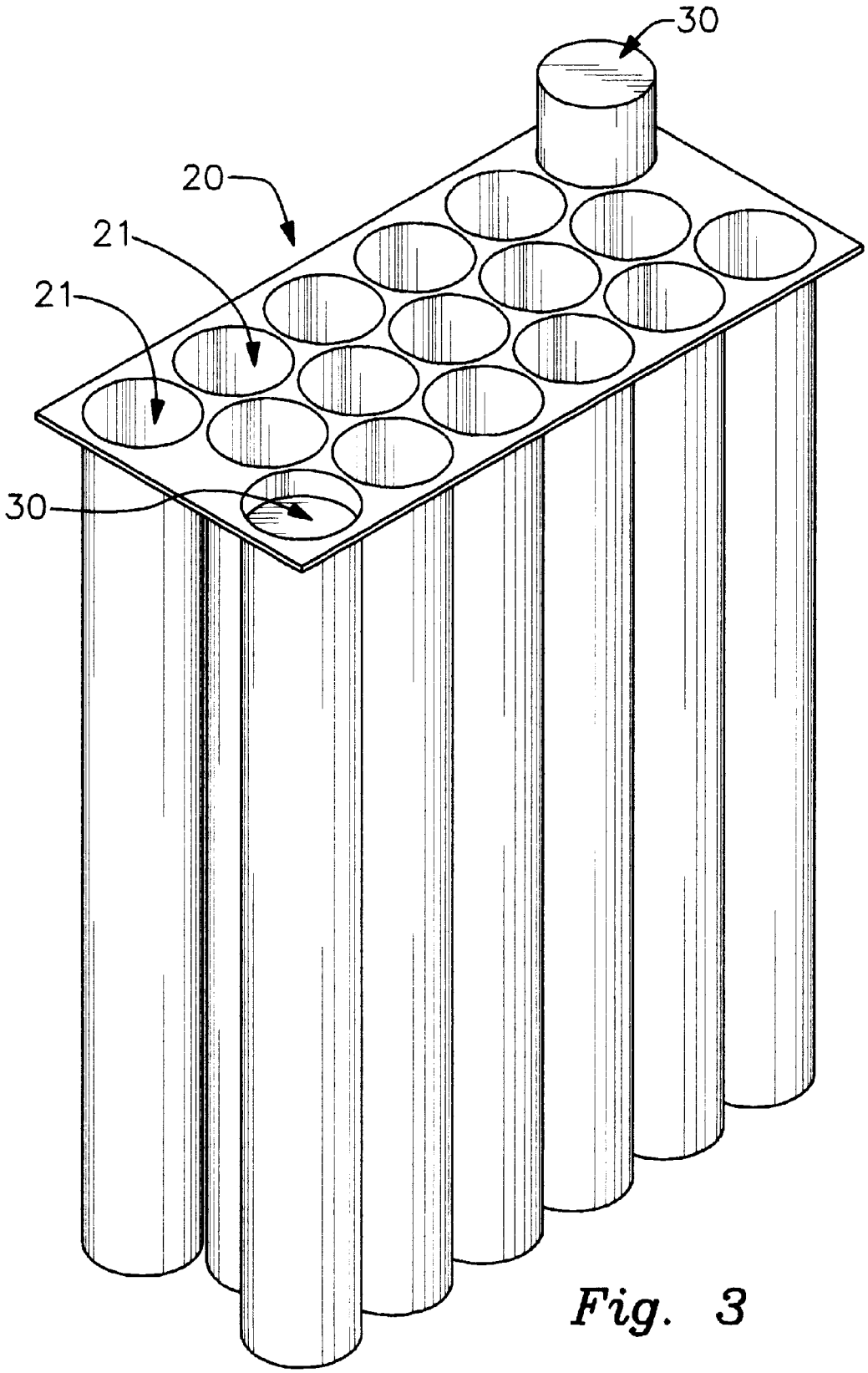
FIG. 3 is a perspective view of the cigarette holding insert of FIGS. 1 and 2.
Figure 4:
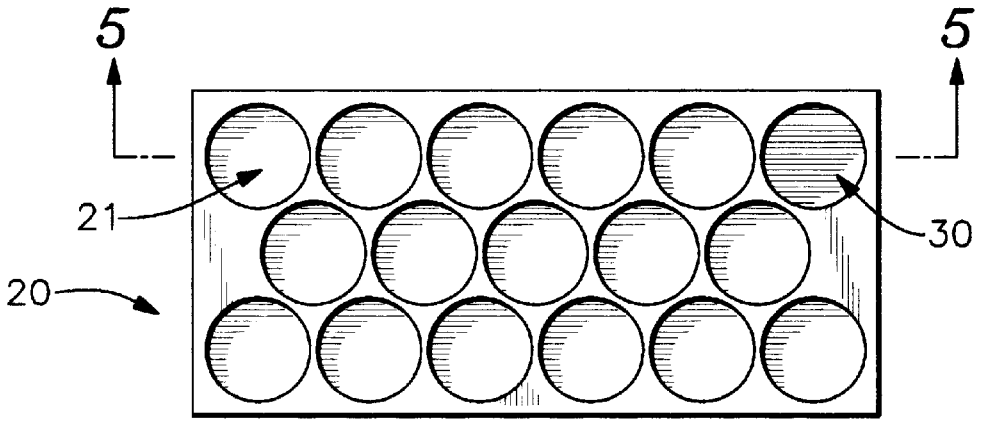
FIG. 4 is a top, plan view of the cigarette holding insert of FIG. 3.
Figure 5:
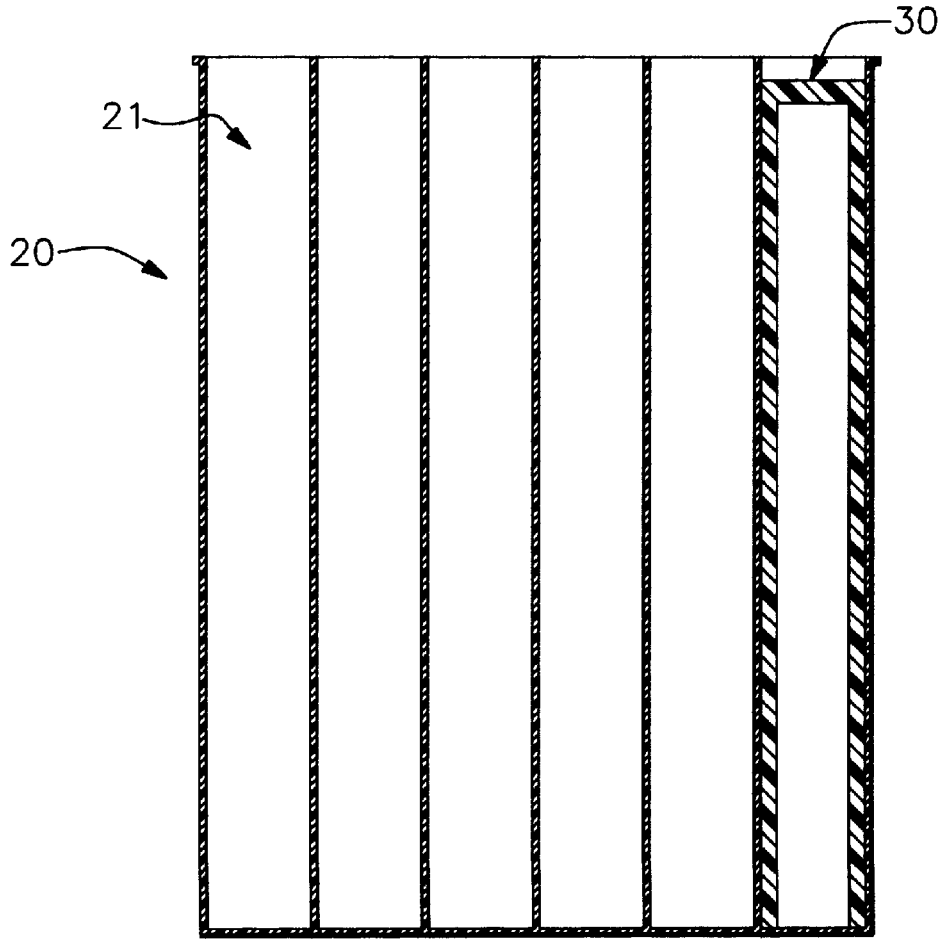
FIG. 5 is a cross sectional view of the insert taken along line 5—5 of FIG. 4.
Figure 6A:
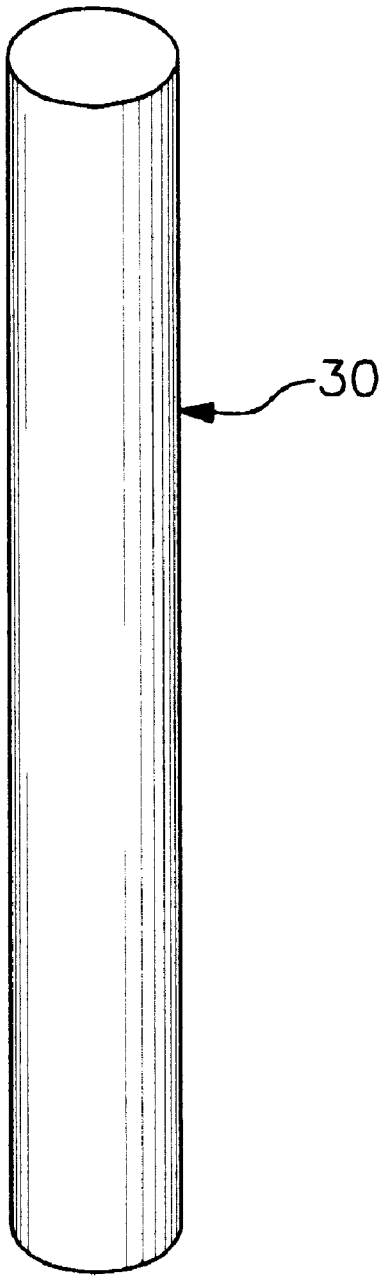
FIGS. 6A and 6B show perspective and cross-sectional views, respectively, of a cigarette holding compartment closure device.
Figure 6B:
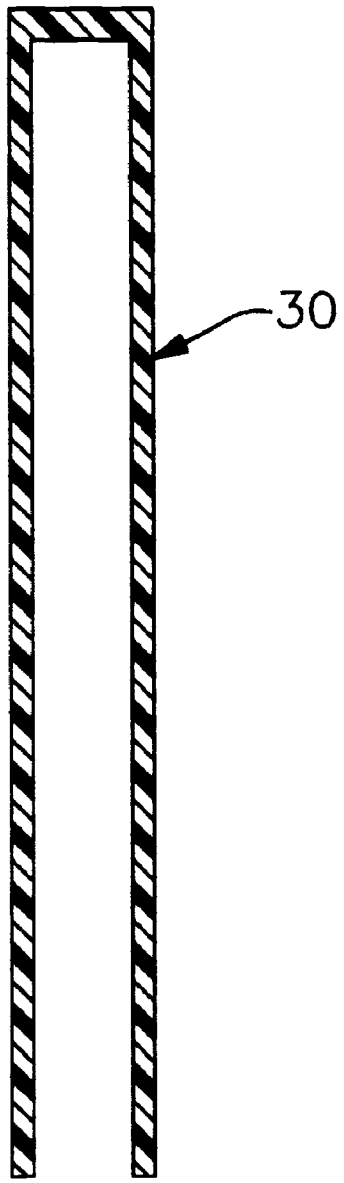

In the preferred embodiment, the user inserts a cylindrical plug 30, as shown in more detail in FIG. 6, into each of the spaces 21 to be closed. FIG. 3 shows one such plug 30 inserted to its full depth, and another that has not yet been pushed all the way in. Plugs 30 may be of a variety of materials, but in the preferred embodiment would be manufactured of a hard plastic. Plugs 30 are illustrated as hollow, but may also be solid. Plugs 30 slide easily into said spaces 21, but fit so snugly that they cannot easily be removed once they have been inserted and pushed all the way down. Thus the reduction in the capacity of the cigarette case is relatively permanent, and the number of spaces that remain open exactly matches the target number.

In the preferred embodiment, plugs 30 are non-removable because they are slightly shorter than the depth of spaces 21 and are manufactured to such close tolerances with regard to spaces 21 that friction alone holds them in place. Plugs 30 may also be fitted with hooking devices that engage circumferential grooves, or otherwise made expandable once in place, or of a construction such that any movement in the outward direction in combination with friction with the walls of spaces 21 would expand plugs 30 circumferentially. Plugs 30 could also be manufactured in such a way that they could be screwed into spaces 21 but could not be screwed back out. Alternately, plugs 30 could be covered or infused with a substance that would act as an adhesive, such that its surface would bond with the interior of space 21.

Although the iron discipline implied in making plugs 30 non-removable would seem to favor successful smoking cessation efforts, in the real world there are many attempts at cessation that fail. Consequently an alternate embodiment would use plugs 30 that could indeed be removed, allowing a faltering smoker to take a few steps backward (by restoring his or her daily cigarette allotment to a previous, higher level). The individual would then resume the cessation attempt at the somewhat higher level instead of abandoning it altogether.

In the embodiment shown in FIG. 3, there are seventeen tubes. A smoker with a target number of 16 cigarettes per day would insert one plug 30 into one space 21 of insert 20, thereby reducing the capacity of the cigarette case 10 to 16 cigarettes. From this point forward the number of unplugged spaces 21 clearly and unambiguously reflects the number of cigarettes that are permitted each day.

The transition from Stage One to Stage Two is marked by another important commitment: the user stops carrying any cigarettes beyond those that he or she loads into the spaces 21 of insert 20 at the beginning of each day, and also pledges to smoke no cigarettes from any other source—that is, he or she will neither buy, borrow, accept or otherwise acquire additional cigarettes from elsewhere.

At first glance it appears that the user is now venturing into unknown and threatening territory—leaving home with nothing but this small "survival kit" to stand between himself or herself and nicotine deprivation. But if enough time was spent in Stage One, he or she will already have been operating under these very same constraints for some time and will be confident that nothing is changing in terms the daily cigarette allotment. He or she will be fully and consistently aware that this is a rationing situation and will have become accustomed to pacing consumption in order that the day's allotment will last until bedtime.

Self-pacing in the use of that daily allotment is straightforward and explicit: the number of empty tubes reveal the number of cigarettes that have been smoked so far during the day. More importantly, the number of cigarettes that remain and must last for the rest of the day can be determined at any time by simply opening the case and counting them.

Cigarette consumption during Stage Two is still normal. Consequently there is no change in accustomed bodily nicotine levels, and there are no cravings or discomfort. Nevertheless, important cessation skills are already developing. The user is gaining trust in the device and method, is becoming increasingly aware of his or her smoking pattern, and is breaking down certain habitual behavior patterns, e.g., that of accepting cigarettes from others.

By the end of Stage Two, the user will be comfortable with the idea of gauging how many cigarettes remain in the cigarette case in relation to the time of day, and will be confident of his or her ability to ration them throughout the day so that they do not run out before bedtime.

At the next stage, herein referred to as Stage Three, the smoker finally feels ready to begin the actual process of tapering cigarette consumption downward. He or she inserts another plug 30 into another space 21 of insert 20, thereby decreasing the capacity of cigarette case 10 by one cigarette. Since the reduction in the capacity of the cigarette case is essentially permanent, the smoker by this action commits to smoking one less cigarette per day from that time forward.

This is an important step, but it is not a big one. For a person who smokes 16 cigarettes a day, from 7 a.m. to 10 p.m., the interval between cigarettes averages 60 minutes. Dropping daily consumption by one cigarette, to 15 cigarettes a day, lengthens that average interval by only four minutes, to 64 minutes. This slight delay is about the smallest sacrifice that a quitting smoker can be asked to make.

The smoker may at first notice some cravings for tobacco, but they will be far less than the torments that likely would have resulted had he or she quit smoking all at once. And since nicotine is water-soluble and is constantly being flushed from the body, the slight reduction in daily cigarette consumption will lead fairly quickly to a slight decrease in the bodily nicotine level. As the body adjusts to the new, lower level of nicotine in the bloodstream, the cravings diminish.

The smoker spends a number of days or weeks at the new cigarette consumption level, guided solely by his or her own feelings. Since for the first time the supply of cigarettes is capped at a level somewhat lower than the original target number, the smoker is now challenged to ration the cigarettes a little more carefully in order that they do not run out before bedtime. Thus he or she is forced to confront and to deal with his or her unconscious, habitual and automatic smoking behaviors and, increasingly, to assume responsibility for and control over the timing of cigarettes consumed and the manner and locations in which they are smoked.

In the preferred embodiment, the device would be marketed in kit form, along with a detailed instructional booklet that would describe many different ways of dealing with these behavioral issues, presented in a readable and easily-understood format and drawing on all relevant experience and research. The kit could also contain audio-visual materials, including but not limited to audio and video cassettes, CD-ROMs, and the like.

When the smoker has adjusted to the new, lower level of cigarette consumption and again feels comfortable and confident, he or she plugs yet another space 21 in insert 20 of cigarette case 10, thereby stepping daily consumption downward by an additional cigarette per day. Again, over a period of time, the bodily nicotine level and cravings for tobacco decline slightly.

In the later stages of the tapering process, when the smoker is consuming many fewer cigarettes per day, plugging yet another hole will increase the interval between cigarettes much more substantially. By the time the smoker in the above example tapers from six cigarettes per day down to five, the average interval between cigarettes increases by 45 minutes, i.e., from three hours to three hours and 45 minutes. However, this takes place against a background of a much lower bodily nicotine level, so that the cravings for tobacco are correspondingly less urgent. An increase of 45 minutes between cigarettes at this stage is far less onerous than it would have been when the individual was tapering from 16 down to 15 cigarettes per day and was accustomed to having a cigarette every 60 minutes.

In accordance with the present invention, there is shown in FIG. 2 a feature that serves to remind the smoker of the desire to quit smoking and to help maintain his or her resolve at times when there may arise a temptation to smoke more than the daily ration of cigarettes. Clear plastic shell 40 is designed to house cigarette case 10 in such a way that the smoker can place behind shell 40 photographs of loved ones, a signed pledge to quit smoking, images of diseased lungs, a list of his or her personal reasons to quit smoking, telephone numbers of smoking cessation hot lines, a summation of the money saved so far by cutting back on cigarette use, and similar motivational or inspirational materials that will be visible each time cigarette case 10 is accessed.

As the tapering process continues, the smoker permanently seals the remaining open spaces 21 in insert 20, one by one over a period of weeks or months, until he or she is smoking only one cigarette every 24 hours. At that point the bodily nicotine level is so low that the final quit is relatively easy. In addition, enough time will have passed that the smoker will have had plenty of time to confront and deal with the psychological and habitual aspects of addiction to cigarettes and will be accustomed to dealing with the common daily "trigger" situations that formerly elicited an automatic, unconscious smoking response.

In sum, this device and method together comprise a structured system for slowly but steadily decreasing daily tobacco use by encouraging and assisting the smoker consciously to regulate daily cigarette consumption and to ratchet consumption irreversibly downward. The process takes place in small steps and in a manner that is guided by the smoker's own circumstances and personal comfort. The invention is inexpensive, easy to understand and to use, and requires no medications of any kind.

In the preferred embodiment, the invention would be about the same size as a pack of cigarettes and would be made entirely of plastic. As such it could be mass produced through the use of standard machinery, at such a low cost that it could be made available to smokers of any income level. The invention would be marketed in the form of a kit, with a booklet containing detailed instructions for use as well as information on the physiology and health consequences of smoking, discussions of the psychological, habitual, unconscious and automatic aspects of smoking and how to deal with them, telephone numbers of national anti-smoking hot lines, URL addresses of smoking cessation support groups on the Internet, and so forth. The kit could also contain such multi-media informational and motivational aids as audio and video cassettes, CD-ROMs, etc.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A cigarette-rationing system in the form of a decreasing-capacity cigarette case, comprising:

a container with a closely fitting lid;

an insert to fit within said container, said insert dividing the interior of said container into a plurality of spaces, each of which spaces can hold a single cigarette; and a plurality of plugging devices, each of which can be inserted independently and irreversibly into one such cigarette-containing space, substantially filling said space so that said space may not again receive a cigarette, the insertion of said plugging device thus achieving a permanent decrease in the capacity of said insert and, therefore, of said cigarette case.

2. A cigarette-rationing system in the form of a decreasing-capacity cigarette case, comprising:

a container with a closely fitting lid;

an insert to fit within said container, said insert dividing the interior of said container into a plurality of spaces, each of which spaces can hold a single cigarette; and a plurality of plugging devices, each of which can be inserted independently but reversibly into one such cigarette-containing space, substantially filling said space so that said space may not simultaneously receive a cigarette, the insertion of said plugging device thus achieving a temporary but reversible decrease in the capacity of said insert and, therefore, of said cigarette case.

* * * * *